United States Patent [19]

Würfel

[11] Patent Number: 4,946,583

[45] Date of Patent: Aug. 7, 1990

[54] PROCESS FOR THE LIQUEFACTION OF COAL

[75] Inventor: Helmut Würfel, Blieskastel, Fed. Rep. of Germany

[73] Assignee: GfK Gesellschaft für Kohleverflüssigung mbH, Saarbrücken, Fed. Rep. of Germany

[21] Appl. No.: 744,554

[22] PCT Filed: Nov. 3, 1984

[86] PCT No.: PCT/DE84/00233

§ 371 Date: May 20, 1985

§ 102(e) Date: May 20, 1985

[87] PCT Pub. No.: WO85/01954

PCT Pub. Date: May 9, 1985

[30] Foreign Application Priority Data

Nov. 5, 1983 [DE] Fed. Rep. of Germany ..... 3340041

[51] Int. Cl.[5] ..... C10G 1/00

[52] U.S. Cl. ..... 208/400; 208/50; 208/108; 208/124

[58] Field of Search ..... 208/8 LE, 10, 50, 11 LE, 208/108, 400, 412, 434, 50

[56] References Cited

U.S. PATENT DOCUMENTS

| | | | |
|---|---|---|---|
| 2,852,441 | 9/1958 | Martin et al. | 208/50 |
| 3,193,486 | 7/1965 | Payne | 208/50 |
| 3,956,101 | 5/1976 | Hara et al. | 208/50 |
| 4,152,244 | 5/1979 | Roichle et al. | 208/10 X |
| 4,213,846 | 7/1980 | Sooter et al. | 208/50 |
| 4,216,074 | 8/1980 | Simone | 208/10 |

*Primary Examiner*—Anthony McFarlane

*Attorney, Agent, or Firm*—James Creighton Wray

[57] ABSTRACT

In a process for the liquefaction of coal under increased pressure and temperature in a liquefaction zone, it is recommended that the liquefaction product exiting the liquefaction zone is fed into a coking area, there cooling the gases and vapors produced, (which are mainly distillate oil vapors), preferably in direct heat exchange with the coal paste. The gases and vapors not condensed during this heat exchange are extracted from the unit as end products. The proposed type of process partially transfers oil production from the liquefaction zone to the coking zone, so that the liquefaction zone can be operated with low pressure. In addition, due to the direct heat exchange of the product vapors with the fresh coal paste, a great part of the exothermic heat created by the liquefaction reactions can be fed back into the process.

18 Claims, 1 Drawing Sheet

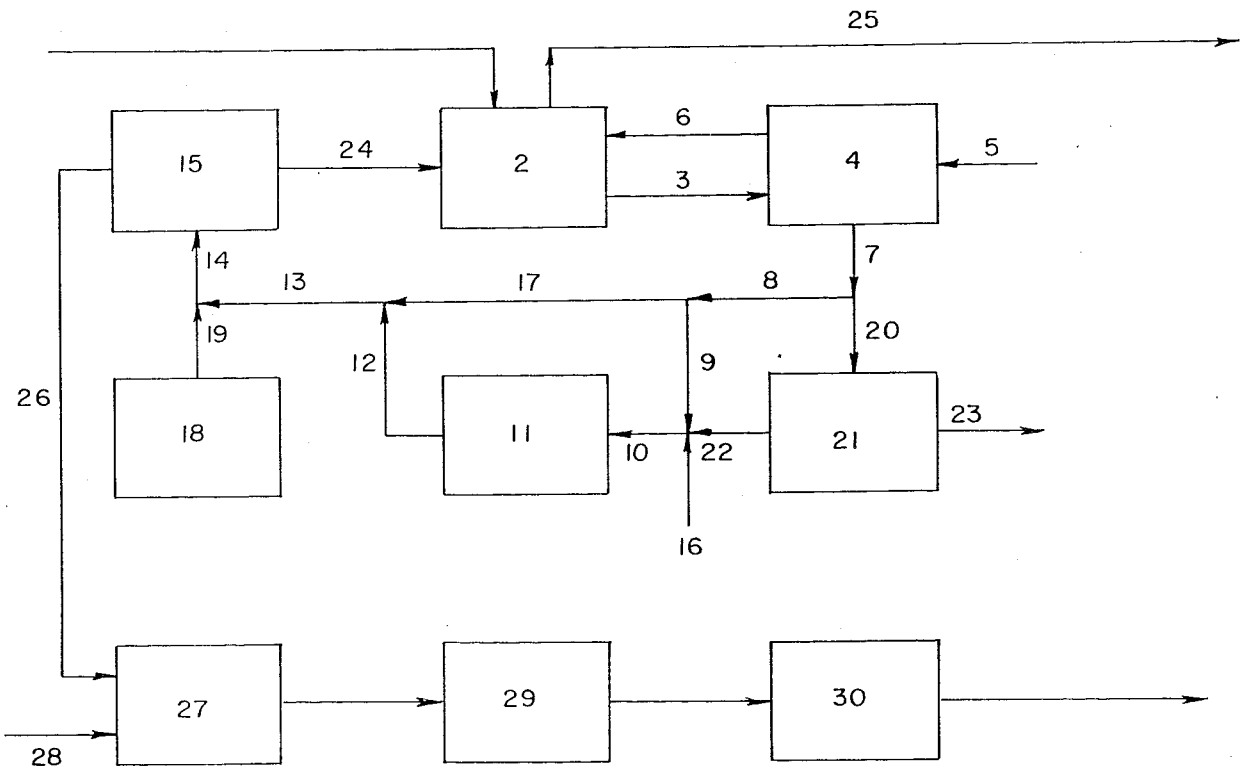
25
5
4
7
20
21
23
30
6
3
8
9
22
16
10
2
17
11
29
24
12
13
15
14
19
18
27
26
28

PROCESS FOR THE LIQUEFACTION OF COAL

BACKGROUND OF THE INVENTION

1. Field of the Invention

The invention concerns a process for the liquefaction of coal, in which the ground up coal is mixed with grinding oil into a paste and is then liquefied with increased pressure and temperature in a liquefaction zone in the presence of hydrogen and, possibly, a catalyst.

2. Prior Art

A process for the liquefaction of coal is already known, in which the coal to be processed is dried and finely ground., and is mixed with grinding oil. The produced coal paste is pumped to reaction pressure, is then heated by heat exchange with a part of the reaction products and, following this, it is heated to the start-up temperature of the liquefaction reaction under the addition of external heat. Finally, it is liquefied in a reaction area in the presence of hydrogen and one or more adequate catalysts. The product fraction exiting the reaction area is decomposed into a steamy overhead fraction consisting of gases, reaction water and distillation oils, as well as into a bottom fraction containing solid matter from not dissociated carbon, ashes, catalyst particles, other high molecular substances difficult to hydrogenate, such as, above all, asphaltenes and fuel oils.

While the overhead fraction is cooled by the heat exchange with the coal paste and is extracted from the unit, the distillates still present from the bottom fraction are separated and are used as grinding oil for the fresh coal.

The disadvantages of this process reside in the high consumption of energy, as well as in the considerable complexity of the devices.

Therefore, the entire amount of coal to be processed must be dried in a special drier with the use of external heat. In the event of a normal water content of approximately 10%, such as in the case of bituminous coal as a raw product, to dry a ton of coal, an energy of approximately 1 Gcal is necessary. In addition, the coal must be ground to a kernel size of $<0.1$ mm. In this known process, the heat exchange process to heat the coal paste is very difficult. On one hand, due to the viscosity of the coal paste, it is very difficult to obtain an even coating of the heat exchanger surfaces. On the other hand, the continued heating of the coal paste in the preheater creates difficulties, since, due to the high temperatures already present, the coal suspended in the coal paste will swell considerably. This leads to a further increase in viscosity, so that lastly, a transport of the coal paste through the preheater is only possible with a strong materials drive, connected with a pulsating passage of the coal paste through it. At this point, sudden pressure increases of up to 10 bar can be generated.

With this known procedure, additionally, the desired yield of distillate oils greatly depends on the hydrogenation conditions (such as pressure and temperature) in the reaction area. Basically, a satisfactory yield of distillate oils of above 50% (based on the type of coal employed) can only be achieved with very acute hydrogenation conditions, with temperatures in the range of about 480° C., and with pressures above 300 bar. It is evident that such conditions, in a large technical unit, are connected with high investment and operation costs, which in turn have a considerable effect on the economy of the process.

SUMMARY OF THE INVENTION

The invention has the task of developing a process of the type mentioned at the beginning, in which the described disadvantages do not arise, and which will make possible an economic liquefaction of coal.

This task is solved according to the invention by feeding the reaction product exiting the reaction area into a coking area, and the hot gases and vapors venting from the coking area are cooled by heat exchange with the coal paste to be heated.

A significant idea regarding the invention is based on not limiting the process to a reaction area operated under acute hydrogenation conditions, but to include an additional coking area into the distillate oil production. In this way, by lowering the pressure or temperature, the liquefaction can be regulated in such a way that, at first, mainly extracts are produced from the coal, with a relatively small amount of distillate oils. The pressure in the reaction area is, as a rule, below 300 bar, preferably, though, between 150 and 250 bar.

The lowering of pressure in the reaction area permits considerable savings, in regard to the configuration of the device, as well as concerning the required pumping energy. In addition, due to the mild liquefaction conditions in the reaction area, less methane and other gaseous hydrocarbons are produced, so that the consumption of hydrogen can be considerably reduced. Since in addition the hydrogen can now be available with total gas pressure under a higher partial pressure (which improves the hydrogen supply in the reaction area), it is not absolutely necessary to employ pure hydrogen, but instead, a less costly mixture containing hydrogen, such as coke oven gas, can be employed. This also means that when employing pure hydrogen, the pressure can be lowered correspondingly in the reaction area.

The coking of the reaction product exiting the reaction area is adequately implemented at temperatures between 450° and 600° C., and the necessary temperature increase of the reaction product to be coked can be obtained by adding external heat with the aid of a conventional pipe heater. The quality and yield of the distillates in the coking area can also be increased by the addition of hydrogen, such as in the form of coke oven gas. In order to avoid coking during the process of heating the reaction product, it has been determined to be advantageous to add and mix a hydrogen-donor oil before it is heated, especially one with a higher boiling fraction than the hydrogen-refined oil yield of the unit.

An additional basic idea of the process according to the invention is based on cooling the hot gases and vapors (which basically are distillate oil vapors) exiting the coking area under the corresponding individual coking temperature in heat exchange with the fresh coal paste to be treated, so that the heat potential from the coking area is utilized for the heating of the coal paste.

According to a further characteristic of the invention, the heating of the coal paste takes place by direct heat exchange, that is, by a thorough mixture of the hot gases and vapors with the fresh coal paste which has already been pumped, partially or completely, to the necessary pressure. During the process of heating the coal paste, all the water contained in the coal is expelled, so that the heat exchange the coal is nearly completely dried. In the process according to the invention, it is now possible to completely avoid the extremely complex drying stage during coal preparation, or to at least partially avoid it in those cases in which the utilized coal has a high water content.

An additional, very significant advantage, results from the fact that, due to the intense heating of the coal through direct heat exchange with the hot product vapors from the coking zone, additional gases are easily dissociated from the coal, gases such as methane, $CO_2$ and reaction water. The coal to be added after the heat exchange in the reaction area is therefore already degasified to a great extent, so that less gases are formed in the reaction area itself. This in turn results in a further increase of the partial hydrogen pressure in the reactor, and consequently, in an improvement of the reaction conditions.

In addition, the use of heat exchangers coated with coal paste is not necessary anymore to heat the fresh coal paste to approximately the start-up temperature of the liquefaction reaction. The amount of heat necessary for heating is added during the direct heat exchange between coal paste and hot coking vapors. A small pipe heater, configured behind the process, following it, can be utilized solely for regulation purposes and to start up the unit. Also, now the complex fine grinding of the coal to the usual $<0.1$ mm can be omitted, since the coal is only led through pipes, and not through heat exchangers, where it could deposit.

During the process of direct heat exchange between the vapors from the coking area and the fresh coal paste, the heavy distillates contained in these vapors condensed. These distillates, together with the fresh coal paste, reach the reaction area, or coking zone, once again, and are dissociated into the valuable product fractions naphta and intermediate distillate. These heavy condensed distillates are also appropriate as solvents for coal, and beyond this, also as thinners for the coal paste. They therefore serve as "grinding oil". Thus, in the process according to the invention, the fresh coal paste can be added as a thick paste, with a content of solid matter of up to 90%. The transport of this thick paste into the area of direct heat exchange can be implemented in a simple manner with the aid of wear resistant transport worm-gears.

The gases and vapors from the coking area not condensed during the direct heat exchange, which mainly consist of residual hydrogen, water steam, low boiling hydrocarbons and, especially, of hydrocarbons in the naphta and intermediate oil range, which are obtained as products, as well as gases and vapors dissociated during the heating of the coal, are separated from the heated coal paste and are fed into a special process. The residual heat of these products can, under certain conditions, be used to heat the necessary fresh hydrogen or the gas containing hydrogen.

According to the invention, the entire reaction product exiting the reaction area can be added to the coking area. In this case, the hot separator usually coupled behind the reaction area can be omitted. An additional advantage consists in that the reaction product reaches the coking area below the temperature of the reaction area (approximately 470° to 490° C.), a temperature which already is within the range of the coking temperature, so that the temperature necessary for heating to coking temperature is small. Under certain conditions, the device for a continued heating can even be omitted. With a process of this kind, the residual hydrogen contained in the reaction product, that is the residual hydrogen not used, can be utilized directly in the coking area.

On the other hand, the gases and vapors still contained in the reaction product (these are mainly residual hydrogen, methane and other gases, as well as distillates in the naphta and intermediate oil range) can be separated at lower temperatures in a hot separator coupled following the reaction area, so that the volume to be fed into the coking area is correspondingly decreased. In this case, the gases and vapors separated in the hot separator can be fed directly into the direct heat exchange with the fresh coal paste, so that also here the heat contents of these gases and vapors can be utilized to heat the fresh coal paste.

If an especially valuable coke is to be produced in the coking area, such as for example electrode coke for metallurgical purposes, it is adequate to execute, beforehand, a separation of the solid matter still contained in the reaction product, such as unused coal, ashes and catalyzer particles. The separation of solid matter can take place in a traditional way, such as by filtration, sedimentation or centrifuging.

In the case of treating coal that is difficult to liquefy, according to a further characteristic of the invention, it has been determined to be advantageous to configure the reaction area in two stages. The pressure of the second stage is higher than the pressure of the first stage and it is preferably in the range of about 10 and 50 bar. In this case, the first reaction stage operates at a pressure similar to the one in the coking area, and the direct heat exchange between the coal paste and the gases and vapors from the coking area, as well as, under certain conditions, those coming from the head of the hot separator, takes place in the first reaction stage.

According to an additional characteristic of the invention, in order to avoid coking during the heating of the reaction product, the heating of the reaction product to the temperature of the coking area can take place by mixing a hot hydrogen-rich gas, obtained by partial oxidation of hydrocarbons.

The hydrogen contents of this gas can be utilized immediately, both for the improvement of coking, as well as (if the reaction area is configured in two stages), to cover the hydrogen requirements in the first reaction stage.

For example, the hot gas containing hydrogen can be created with the partial oxidation of methane, and, among other products, hydrogen and carbon monoxide are formed. It is evident that the the hot gas containing hydrogen can be generated through partial oxidation, that is, through gasification of the coke produced in the coking area, or, if a residue separation has taken place before coking, by gasification of this residue.

The addition and mixture of the hydrogen-rich gas with the reaction product to be coked takes place in an appropriate way in several locations, that is, at least in two points placed one after the other in the direction of flow of the residue. This guarantees a stepwise, uniform heating of the residue, so that the coking temperature is reached only immediately before the introduction of the reaction product into the coking area. Under certain conditions, it can also be advantageous to implement the heating of the reaction product to be coked in two stages, in which in the first stage, external heat is added in a pipe heater, and in the second stage, following the first stage, heat is added by means of the hot hydrogen-rich gas.

According to a further characteristic of the invention, coke produced in the coking area is gasified and the raw gas produced is cleaned, partially converted, and then it is partially subjected to a Fischer-Tropsch synthesis, for the production of paraffinaceous carbohydrates, especially diesel fuel.

In this way, aromatic carbohydrates, which are the basis for the obtention of benzenes, can be produced in one unit, once during the liquefaction and coking of coal, whereas during the Fischer-Tropsch synthesis, paraffinaceous carbohydrates are produced. Since nearly all the volatiles have escaped from the coke to be gasified, a nearly clean, tar-free gas is produced even during gasification in a fixed-bed gasifier, which is the most economic gasifier to operate, as seen from a present day viewpoint, which, in contrast to the gasification of pure coal, considerably reduces the the complexity of gas preparation for the Fischer-Tropsch synthesis.

Beyond this, such a process is characterized by a considerable flexibility in regard to the production of gasoline or diesel fuel. In case more Fischer-Tropsch products are required, the unit can be operated in a simple way by lowering the pressure and temperature in the reaction area or in the coking area to produce less distillates, which, in turn, produces more coke for gasification, and the following Fischer-Tropsch synthesis is omitted. On the other hand, in a reverse mode, in the event of an increased demand for aromatic hydrocarbons for the production of gasoline, the conditions for coal treatment in the reaction area, or in the coking area, can be increased by augmenting pressure and temperature, or, also, by increasing the presence of hydrogen, so that more distillates and less coke for gasification are produced.

According to a further characteristic of the invention, is has been determined to be advantageous to use a heavy oil fraction to grind the coal, or, in case of processing petroleum, to use hydrogenation residues, especially hydrogenation residues still containing catalysts. Such grinding oils originating from petroleum are characterized, in contrast to coal oils, by having an increased hydrogen contents, which can be transferred to the the coal in cases of especially mild liquefaction conditions. Also, in case of using petroleum hydrogenation residues still containing catalyst as grinding oil, under certain conditions, an additional catalyst can be omitted.

The process according to the invention is not limited to the processing of bituminous coal or lignite. On the contrary, other materials containing hydrocarbons can also be treated with the same advantages, especially materials such as heavy oils originating from petroleum, or, also, oil bearing sands, or oil shale.

While the invention has been described with reference to specific embodiments, modifications and variations of the invention may be constructed without departing from the scope of the invention, which is described in the following claims.

BRIEF DESCRIPTION OF THE DRAWING

The FIGURE illustrates a schematic diagram of a device for the execution of the claimed process.

DETAILED DESCRIPTION OF THE DRAWING

According to the FIGURE, the fresh coal paste to be treated, which has already been mixed with a grinding oil and which has been pumped up to a pressure of approximately 20 bar, showing a coal contents of approximately 80 to 90 % per weight, is fed into a mixer 2, via pipe 1, together with a catalyst. In the mixer, the coal is heated by direct heat exchange with hot gases and vapors, the origin of which is explained further on, to a reaction start-up temperature of approximately 400° C. The coal paste is fed via pipe 3 into a reaction area 4, and is liquefied in this area in the presence of hydrogen, which is introduced via pipe 5 into the reaction area 4 under relatively mild conditions, that is, with a relatively low pressure of only approximately 200 bar and with a temperature of about 450° C.

The reaction product obtained in the reaction area 4 is composed of a gaseous phase and of a liquid phase containing solid matter.

In the present implementation example, the hot gaseous phase, which mainly contains the nonutilized hydrogen, low boiling hydrocarbons, such as methane, ethane and other gases, as well as distillates in the boiling point range of naphta and intermediate oil, is fed back into the mixer 2 via pipe 6 and is thoroughly mixed there with the fresh coal paste, and during mixing, it is cooled by heat exchange with the coal paste.

The liquid phase containing solid matter created in reaction area 4 mainly consists of coal extract, that is, bitumen, as well as distillates within the boiling point range of heavy oil. Additionally, this phase also contains solid matter, such as untransformed coal, ashes and unused catalyst. This liquid reaction product is fed into an oven 11 via pipes 7, 8, 9 and 10, and in the oven, it is heated to a temperature of about 500° C. through the addition of foreign heat, and is then fed into a coking area 15 via pipes 12, 13 and 14. In the coking area the liquid product fraction containing solid matter is coked. Apart from the end product coke, gases and vapors are created, especially distillates within the boiling point range of naphta and intermediate oil. In order to improve the quality of the distillate and to increase the yield of distillates, the product fraction to be coked receives hydrogen, such as coke oven gas, via pipe 16.

According to an additional version of an implementation, the heating of the product fraction to be coked can also take place by direct addition and mixing of a hot gas mixture containing hydrogen, immediately before entry of the product fraction into the coking area 15. In this case, the product fraction is fed directly into the coking area 15 via pipes 7,8, 17, 13 and 14, while the hot gas containing hydrogen is created in a gas generator 18 through partial oxidation of methane or a different carbohydrate, and is added and mixed with the product fraction to be coked via pipe 19. Here, the partial oxidation can be controlled in such a way, that on one hand, the oxidation of carbon to carbon monoxide generates enough heat to to heat the fraction to coking temperature, and on the other hand, sufficient hydrogen is also produced for the coking area.

If an especially pure coke is to be produced in the coking area, such as, for example, for the production of electrodes for metallurgical processes, before coking the reaction product, the solid matter is removed from the same. In this case, the liquid reaction product containing solids is fed from the reaction area 4 via pipes 7 and 20 first into the solid matter separating unit 21, in which the solid matter is separated in a known way, i.e. through filtration, sedimentation or centrifugation. The product fraction to be coked, which is now reasonably free of solid matter, is suctioned off from the solid matter separation device, and is fed into the coking area 15, depending on the chosen type, for its further heating, via pipes 9, 17, 13 and 14, or via pipes 12, 13 and 14. The residue with a rich contents of solid matter produced in the solid matter separating unit 21 is extracted from the unit via pipe 23. Under certain conditions, this residue, or at least a part of the coke produced in the coking area, can be used, in the gas generator 18, for the generation of the hot gas containing hydrogen.

The vapors generated in coking area 15 are extracted at a coking temperature of about 500° C. via pipe 24 and are also added to the mixer 2. These vapors, together with the vapors from pipe 6, cause the heating of the fresh coal paste to about the start-up temperature for the reaction area 4, so that, (here lies a significant advantage of the proposed process) the application of external heat in complex heat exchangers to heat the fresh coal paste can be omitted. During the process of direct heat exchange of the mentioned gases with the coal paste, nearly all the water is expelled from the coal, so that the energy expensive drying of the coal during its preparation can also be omitted.

The gases and vapor produced in the mixer, which mainly consist of residual hydrogen, water steam, small amounts of hydrocarbons with low boiling points, such as methane and ethane, and other products, and especially the distillates which are generated as products within the naphta and intermediate oil range, are extracted from the unit via pipe 25 and are fed into a distillation unit (not shown) for further processing. Because of their aromatic character, these distillates are especially suited for the manufacture of gasoline.

Particularly with the utilization of coals that are difficult to break down, has proven to be advantageous to configure mixing stage 2 as a reaction stage for coal, and to operate the area following it as a second reaction stage, with a higher pressure. In this case, the hydrogen is increased through pipes 16 or 19 in such a way that the available hydrogen is not only sufficient for the coking area, but, additionally, also for the first reaction stage, which, is appropriately operated at about the pressure of the coking area.

On the other hand, in the case of coals that are easy to break down, and also in the case of hydrogenation of heavy oils or oil bearing sands, the direct heat exchange between the hot product vapors and the raw material can be integrated directly in the reaction area 4, and this area is operated at about the pressure of coking area 15, which is of 10 to 30 bar. The distillation vapors obtained as end products in this case can be extracted directly from the head of reaction area 4.

In this implementation example, the coke produced in coking area 15 is fed into a gasifier 27, preferably a fixed bed gasifier, via a conduit 26, and there is gasified into a raw gas containing carbon monoxide and hydrogen. The necessary oxygen flows into the gasifier 27 via pipe 28. The raw gas from the gasifier 26 is fed into unit 29, is cleaned and converted there, and following this, it is subjected to a Fischer-Tropsch synthesis in a unit 30. The hydrocarbons created in unit 30 are, due to their paraffinaceous character, especially suited for the manufacture of diesel fuel.

Accordingly, with the proposed process it is possible to produce fuel for gasoline engines, as well as for diesel engines, in one single unit, and, depending on the requirements, production can be easily modified in favor of a particular type of fuel. Milder process conditions (pressure, temperature) in the coking or reaction area, for example, reduce the production of aromatic distillates in favor of coke production, while, in the inverse case, with acute hydrogenation and coking conditions, the yield of coke diminishes in favor of the yield of distillates.

To bind the sulfur contained in coal, which would be dissociated during coke combustion, such as in a fluidized layer, sulfur binding materials, such as calcium oxide or calcium carbonate, can be added to the fresh coal paste and/or to the product fraction to be coked, and, as it has been shown, these calcium compounds can, due to their surface active effect, even contribute to a further increase of the oil yield.

I claim:

1. Process for the liquefaction of coal in which ground coal is mixed with grinding oil to form a coal past and is treated with pressure and heat in a liquefaction zone in the presence of hydrogen to form a liquefaction product having a gaseous phase and a liquid phase containing solid matter, comprising, passing the liquefaction product from the liquefaction zone to a coking zone, mixing in a mixing zone hot gases and vapors exiting the coking zone with the fresh coal paste which is fed into the liquefaction zone thereby cooling the hot gases and vapors in a direct heat exchange with the coal paste which is heated in the heat exchange, wherein heavy distillates in the hot gases and vapors condense in the fresh coal past, and wherein uncondensed distillates are extracted from the mixing zone, and passing heated coal paste, together with the condensed residue, to the liquefaction zone, wherein pressure in the liquefaction zone is between 150 to 250 bar.

2. Process according to claim 1, further comprising separating the gases and vapors contained in the gaseous phase of the liquefaction product and feeding said gases and vapors immediately back into the mixing zone to the direct heat exchange with the coal past.

3. Process according to claim 1, further comprising, at least partially, separating and eliminating the solid matter of the liquefaction phase prior to coking of the liquefaction product.

4. Process according to claim 1, further comprising heating the liquefaction product, prior to coking, to a temperature of between 450° and 600° C.

5. Process according to claim 4, wherein the heating of the liquefaction product is by applying indirect heat.

6. Process according to claim 1, further comprising mixing hydrogen with the liquefaction product prior to coking.

7. Process according to claim 4, further comprising mixing a hot gas containing hydrogen, obtained by partial oxidation of a fuel with the liquefaction product.

8. Process according to claim 7, further comprising mixing the hot gas with the liquefaction product in at least two locations, placed one after the other, in the direction of flow of the liquefaction product.

9. Process according to claim 4, wherein the heating of the liquefaction product comprises adding external heat or adding a hot gas containing hydrogen or both.

10. Process according to claim 4, further comprising adding hydrogen-donor oils to the liquefaction product prior to heating.

11. Process according to claim 1, further comprising gasifying coke produced in the coking zone, thereby producing a crude gas, and subjecting the crude gas to a Fischer-Tropsch synthesis, and producing paraffinaceous hydrocarbon fractions having a high boiling point.

12. Process according to claim 1, further comprising mixing sulfurbinding materials with the fresh coal prior to being fed to the mixing zone.

13. Process according to claim 1, wherein the grinding oil is petroleum fraction.

14. Process of claim 1, further comprising mixing sulfurbinding materials with the liquefaction product.

15. Process of claim 12, further comprising mixing the sulfur-binding materials with the liquefaction product.

16. Process for the liquefaction of coal in which ground coal is mixed with grinding oil to form a coal paste and is treated with pressure and heat in a first and a second liquefaction zone in the presence of hydrogen to form a liquefaction product having a gaseous phase and a liquid phase containing solid matter, comprising, passing a liquefaction product from the second liquefaction zone to a coking zone, mixing in the first liquefaction zone hot gases and vapors exiting the coke zone with the fresh coal paste fed into the first liquefaction zone, thereby cooling the hot gases and vapors in a direct heat exchange with the coal paste which is heated in the heat exchange, wherein heavy distillates in the hot gases and vapors condense in the fresh coal paste, and wherein uncondensed distillates are extracted from the first liquefaction zone, and passing heated coal paste, together with the condensed residue, to the second liquefaction zone, wherein pressure in the first liquefaction zone is lower than the pressure in the second liquefaction zone.

17. Process according to claim 16, wherein the pressure in the first liquefaction step is between 10 and 50 bar.

18. Process according to claim 16, wherein the coking zone operates substantially under the same pressure as that of the first step, and wherein direct heat exchange between the vapors and gases from the coking area and the coal paste takes place in the first liquefaction zone.

* * * * *